US005291823A

United States Patent [19]

Kramps

[11] Patent Number: 5,291,823

[45] Date of Patent: Mar. 8, 1994

[54] PRESSING DEVICE FOR WINDING MACHINES FOR PRODUCING TUBULAR PACKS OF PRINTED PRODUCTS

[75] Inventor: Jan W. Kramps, Hiuzen, Netherlands

[73] Assignee: Ferag AG, Hinwil, Switzerland

[21] Appl. No.: 882,153

[22] Filed: May 13, 1992

[30] Foreign Application Priority Data

May 14, 1991 [CH] Switzerland ..... 01454/91

[51] Int. Cl.[5] ..... B30B 9/00

[52] U.S. Cl. ..... 100/76; 53/118; 242/59; 242/67.1 R

[58] Field of Search ..... 100/5, 40, 76, 86, 87, 100/88; 242/59, 67.1 R, 67.2; 53/118, 587

[56] References Cited

U.S. PATENT DOCUMENTS

| | | | |
|---|---|---|---|
| 789,789 | 5/1905 | Bellamy | 242/59 |
| 2,157,765 | 5/1939 | Lanter | 100/87 X |
| 2,270,043 | 1/1942 | Fourness et al. | 242/67.1 R |
| 3,112,087 | 11/1963 | Fornataro | 100/88 X |
| 3,957,220 | 5/1976 | Beck et al. | 242/59 X |
| 4,034,928 | 7/1977 | McDonald et al. | 242/59 |
| 4,114,530 | 9/1978 | Miller | 100/87 |
| 4,909,015 | 3/1990 | Leu | 242/59 X |
| 4,967,536 | 11/1990 | Reist | 53/587 X |

FOREIGN PATENT DOCUMENTS

| | | | |
|---|---|---|---|
| 0095790 | 12/1983 | European Pat. Off. . | |
| 2424911 | 1/1976 | Fed. Rep. of Germany | 242/67.1 R |
| 2516226 | 10/1976 | Fed. Rep. of Germany | 242/67.1 R |
| 1398600 | 3/1965 | France . | |

*Primary Examiner*—Stephen F. Gerrity
*Attorney, Agent, or Firm*—Walter C. Farley

[57] ABSTRACT

A pressing apparatus for a winding machine for winding printed products supplied in scale formation has two pressing belts (5.1, 5.2) which together cover at least 270° of the roll periphery. Uniform, strong contact pressure on the roll is exerted which can be controllable. Groups of components guiding and supporting the belts are movable to completely withdraw the belts from the roll, allowing a full roll to be ejected easily and a new mandrel to form a new roll can be loaded in a short time.

7 Claims, 7 Drawing Sheets

PRESSING DEVICE FOR WINDING MACHINES FOR PRODUCING TUBULAR PACKS OF PRINTED PRODUCTS

FIELD OF THE INVENTION

This invention relates to printing presses and more specifically to a pressing device for winding machines for producing tubular packs of printed products such as newspapers, magazines and the like supplied in scale formation and wound up to form a roll.

BACKGROUND OF THE INVENTION

Various kinds of winding machines are known for winding printed products up so as to form a roll and maintaining them in the wound arrangement by means of a holding element. Such holding elements are typically bands, string, foils and the like. In order to be able to roll up the printed products in a roll or tubular form and simultaneously or in a subsequent operating step apply the holding element, it is necessary to have guidance or pressing devices which initiate and aid the winding process. U.S. Pat. No. 4,909,015 discloses an apparatus of this general type which makes it possible to use holding elements with limited rigidity. A plastic foil or film is unwound from a delivery roll and is applied under tensile stress to an advancing flow of imbricated printed products. The film and a section of the printed products are supplied by either separate of a common supply means to a winding station where they are wound together around a winding mandrel. At the end of the winding process, the film is cut off at a desired point. Winding is accomplished by the freely rotatable winding mandrel and is driven by an endless belt which drives the mandrel with the printed products and which also exerts certain radial pressure on the printed products.

At the start of the winding process, when the endless belt engages the periphery of the winding mandrel or the wound printed products to a significant extent, relatively good contact pressure is obtained. However, the more the printed products are wound, the less favorable is the sector covered by the belt. Near the end of the winding process, the periphery of the roll is engaged by the belt only over the a sector of 180°. This can have a disadvantageous influence on the winding process, particularly during the final winding phase. The desired strength of the roll suffers and controlled pressing of the printed products and the holding element holding them together can no longer be assured. A further disadvantage of this and other known apparatus is the time taken and the mechanically rather complicated ejection process for a finished printed product roll.

The aforementioned disadvantages and problems become even more serious if it is necessary to wind the more recently known compact rolls, such as is shown in U.S. Pat. No. 5,101,610 in which rolls are formed from a densely compressed scale flow. The radially outwardly-acting forces which then occur, as well as the starting of the winding process, including the deflecting or reversing of the scale flow during winding, can only inadequately be dealt with using conventional devices.

SUMMARY OF THE INVENTION

An object of the invention is therefore to provide a pressing device which, throughout the winding process, ensures pressing and securing action covering most of the roll periphery and which permits the production of precisely wound, compact, tubular packs of high rigidity together with simple and rapid removal of the finished printed product rolls.

BRIEF DESCRIPTION OF THE DRAWINGS

This invention is described in greater detail hereinafter with reference to the embodiments shown in the attached drawings wherein.

DESCRIPTION OF THE PREFERRED EMBODIMENTS

The present invention deals especially with the manner of pressing, securing and guiding printed products during the winding process. The pressing device embodiments described with reference to the drawings can be used together with different types of winding machines but are particularly suited for use with a winding machine according to U.S. Pat. No. 4,909,015.

Figure 1:
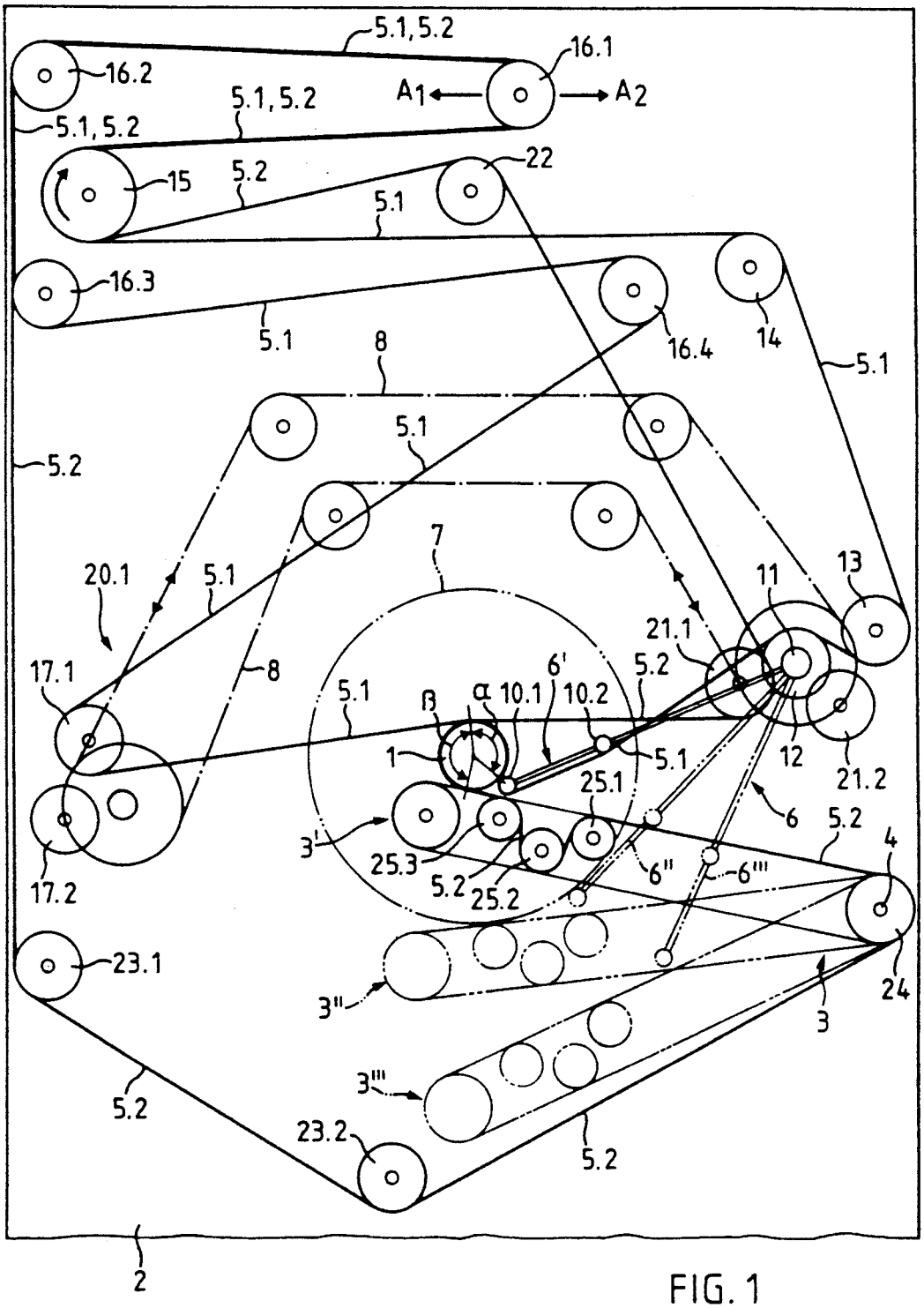
FIG. 1 is a schematic side elevation of a first embodiment of a pressing apparatus in accordance with the present invention at the start of the winding process with the mandrel empty.

FIG. 1 shows a first embodiment of the pressing and securing device at the start of the winding process. The construction and operation of the printed product and holding element supply means, the drive, etc., corresponds to the apparatus of U.S. Pat. No. 4,909,015 in which a detailed representation and description are provided. Thus, with respect to that overall apparatus, the following description will include comments about that apparatus only to the extent that they are necessary for understanding the device of the present invention.

In known apparatus, the elements to which this invention relates were mainly understood to be auxiliary devices for assisting winding, i.e., they initiated deflection and winding of the linear printed product flow and simultaneously served as pressing means. However, according to the present invention which produces compact printed product rolls of very considerable strength, use is made of a device which performs an effective pressing and securing function by covering most of the roll periphery and simultaneously, almost as a secondary function, assists the start of winding. In other words, an effective pressing device is created whereas conventional structures were merely based on an auxiliary device for the winding process.

A winding mandrel 1 on which the printed products are wound is, in a conventional manner, suspended and mounted in a freely rotatable manner in a frame 2 (not shown). A belt conveyor 3 is pivotably attached to a fixed pivot pin 4 and also to frame 2. Three possible pivoting positions 3', 3'', and 3''' of the belt conveyor are shown, position 3' with the mandrel empty being shown in continuous lines and the other two positions being shown in dot-dash lines. According to the invention, the roll is secured and pressed over its entire periphery, i.e., over an optimum sector of 360° such that uniform, all-around contact pressure is radially exerted against winding mandrel 1. Thus, according to the invention, at least two pressing belts 5.1 and 5.2 are provided which loop around the roll periphery over a sector of at least 270° to achieve the optimum looping sector. Belts 5.1 and 5.2 are endless belts which are located in the vicinity of the winding mandrel and are guided around a plurality of deflection or guide pulleys so that they engage on part of the periphery of the winding mandrel 1 or, during the winding process, the printed product roll 7, indicated by a dot-dash circle. At the beginning of the winding process, the first winding belt loops around the periphery of empty mandrel 1 over a sector $\alpha$ which, in the present embodiment, is approximately 140°. In turn, the second belt 5.2 ensures a pressing action over a second sector $\beta$ of approximately 160° to 180°. Because these sectors $\alpha$, $\beta$ overlap, there is an open sector of approximately 50° to 60° whose periphery is not covered or engaged by the pressing device. If even more complete looping is to be obtained (close to 360°), then a third belt can be used. The printed products are supplied in the open sector from right to left, in the present embodiment, by belt conveyor 3.

This looping of the winding mandrel is obtained by so arranging the two belts 5.1, 5.2 that, at the start of the winding process, a portion of the first belt 5.1 is guided to the winding mandrel by means of a swivel arm 6 (in its position 6' with the roll empty shown in continuous line form) whose free end approximately forms the contact point with the periphery of mandrel 1 with the periphery of the belt engaging over a sector of at least 130°, and preferably 140°, and the second belt 5.2 is guided in a U-shaped loop around the winding mandrel 1 with its periphery engaging a sector of at least 160°, and preferably 170°, the two sectors overlapping by a maximum of 15° and preferably only 10°.

Because the roll geometry is permanently changed during the winding process, it is important, especially at the end of the process, that the aforementioned pressing action remains constantly good, i.e. that there is a minimum open sector and that the pressing occurs in a uniform manner. An advantage of the inventive device is that it is also possible to secure and press in an optimum manner a roll with irregularities along its periphery. This also occurs in the case of the aforementioned compact rolls, because they only have an approximately circular cross-section.

The course of the first pressing belt 5.1 will now be described in greater detail and is followed in the winding direction (i.e. counter-clockwise in the drawing) starting from the winding mandrel. Directly at the winding mandrel, belt 5.1 is guided around a small guide pulley 10.1 (or a static deflector with small radius of curvature), which is in turn fixed to a free end of swivel arm 6. Swivel arm 6 is shown in three possible swivel positions 6', 6'' and 6''', position 6' being shown in continuous line form with the roll empty and the two other positions being shown in dot-dash line form. This swivel arm is rotatable about an axle 11 and has a length corresponding roughly to the diameter of the largest printed product roll to be wound. The arm is positioned in such a way that, at its inner position 6', the arm is nearly tangential to the winding mandrel 1 and its free end approximately forms the contact point with the mandrel periphery. During the winding process the free end moves radially outward simultaneously with the roll radius increase.

At an intermediate position 6'' with the roll full, the swivel arm or the pressing belt guided at the free end round the guide pulley 10.1 engages tangentially on the full roll again. The pressing belt is guided on the swivel arm by a second small pulley 10.2. The radius of the small pulley 10.1 and preferably also that of the guide pulley 10.2 on swivel arm 6 is preferably less than 0.5 cm. This allows small dimensions of swivel arm 6 and therefore, despite constricted space conditions, there is close engagement of the free end of swivel arm 6, and therefore the belt, on the roll 7. A further guide pulley 12, whose axle coincides with the swivel arm axle 11 and which has a larger diameter than the pulleys 10.1 and 10.2, is used with additional guide pulleys 13 and 14 for reversing and guiding belt 5.1 up to a driving pulley 15. Pulley 15 is driven in a conventional manner by means of a not shown drive such as an electric motor. The belt is guided to a specifically positioned guide pulley 17.1 by four further guide pulleys 16.1 to 16.4. Guide pulley 17.1 is located in an area 20.1, Which is substantially on the opposite side of winding mandrel 1 from swivel arm 6 or small guide pulley 10.1. As a result of the arrangement of guide pulley 17.1 and small guide pulley 10.1 on swivel arm 6, pressing belt 5.1 engages winding mandrel 1 over the sector $\alpha$. Endless belt 5.1 is kept under tensile stress. The belt length or guidance is so selected that any length change required by the roll diameter increase is taken up by a compensating movement of guide pulley 16.1, which is common to both belts 5.1, 5.2, and moves in the direction of the two arrows $A_1$, $A_2$. This compensating movement can take place by spring tension or a drive in the direction of arrows $A_1$, $A_2$. As a function of requirements, this compensating movement of guide pulley 16.1 can be controlled during the winding process and thereby the contact pressure of the belts 5.1, 5.2 can be influenced in a time dependent manner or according to other predeterminable parameters, which can be utilized for additional roll stabilization. The reciprocal arrangement of driving pulley 15 and compensating guide pulley 16.1 is particularly advantageous. Guide pulley 16.1 follows driving pulley 15 in the driving or winding direction (i.e. it is in the loose side). If belt extension becomes necessary due to a roll size change during winding, then by a compensating movement in the direction of arrow $A_1$, extension or lengthening can be brought about without it being necessary to remove the belt via the driving pulley, i.e. there is no rubbing or slipping of the belt on the driving pulley.

The course of the second pressing belt 5.2 is also described in the winding direction, i.e., counterclockwise. Starting from winding mandrel 1, belt 5.2 is first guided around a first guide pulley 21.1 and then a second guide pulley 22 to driving pulley 15, which simultaneously drives the first belt 5.1. Guide pulleys 16.1 to 16 3 are also used for guiding both belts 5.1 and 5.2. It is readily apparent that for this reason both the driving pulley and the jointly used guide pulleys must have adequate width so that both belts can be guided in juxtaposed form. In other words, the belts are displaced from each other in a direction perpendicular to the plane of the drawing. This is necessary because the pressing sectors on roll 7 can partly overlap. Second belt 5.2 is then guided by means of two further guide pulleys 23.1, 23.2 under or around belt conveyor 3, so that the latter does not disturb the pressing belt course in its outer end position 3'''. Finally, belt 5.2 is guided by a guide pulley 24, whose axis coincides with axis 4 of belt conveyor 3, and also by three smaller guide pulleys 25.1 to 25 3 in the belt conveyor back to the winding mandrel 1. The first guide pulley 21.1 for second pressing belt 5.2 is arranged in such a way that belt 5.2 coming from the belt conveyor or its small guide pulleys 25.1 to 25.3 forms a U-shaped loop round the winding mandrel 1 and therefore engages over the aforementioned sector $\beta$ of approximately 180° and provides the necessary pressing action.

In order to obtain the looping present when the winding mandrel is empty during the winding process or in order to even improve the pressing area (sectors $\alpha$ and $\beta$), it is necessary to adapt the arrangement of pivotable belt conveyor 3 and swivel arm 6 with respect to one another and to winding mandrel 1. The drawing shows a favorable arrangement. The angle formed by swivel arm 6 and belt conveyor 3 when engaging the empty winding mandrel (swivel positions 3' or 6') is between 30° and 45° and in the present embodiment is approximately 40° and the ratio of the spacings of the two pivot axes 4 and 11 from the winding mandrel axis is approximately 1.3 to 1.4

Guide pulley 17.1 for first pressing belt 5.1 and guide pulley 21.1 each have an associated, corresponding pulley 17.2 and 21.2 with which, in each case, they form a functional pair. These two pairs, 17.1, 17 2 and 21.1, 21.2, are movable by means of a conveying chain 8 along a link or rail (not shown) or by a stable chain guide. This movement path makes it possible to raise the pressing belts from their pressing positions to free the roll for the purpose of ejecting the full printed product roll. The precise operation of those guide pulley pairs 17.1, 17.2 and 21.1, 21.2 will be described in greater detail with reference to FIG. 3.

Figure 2:
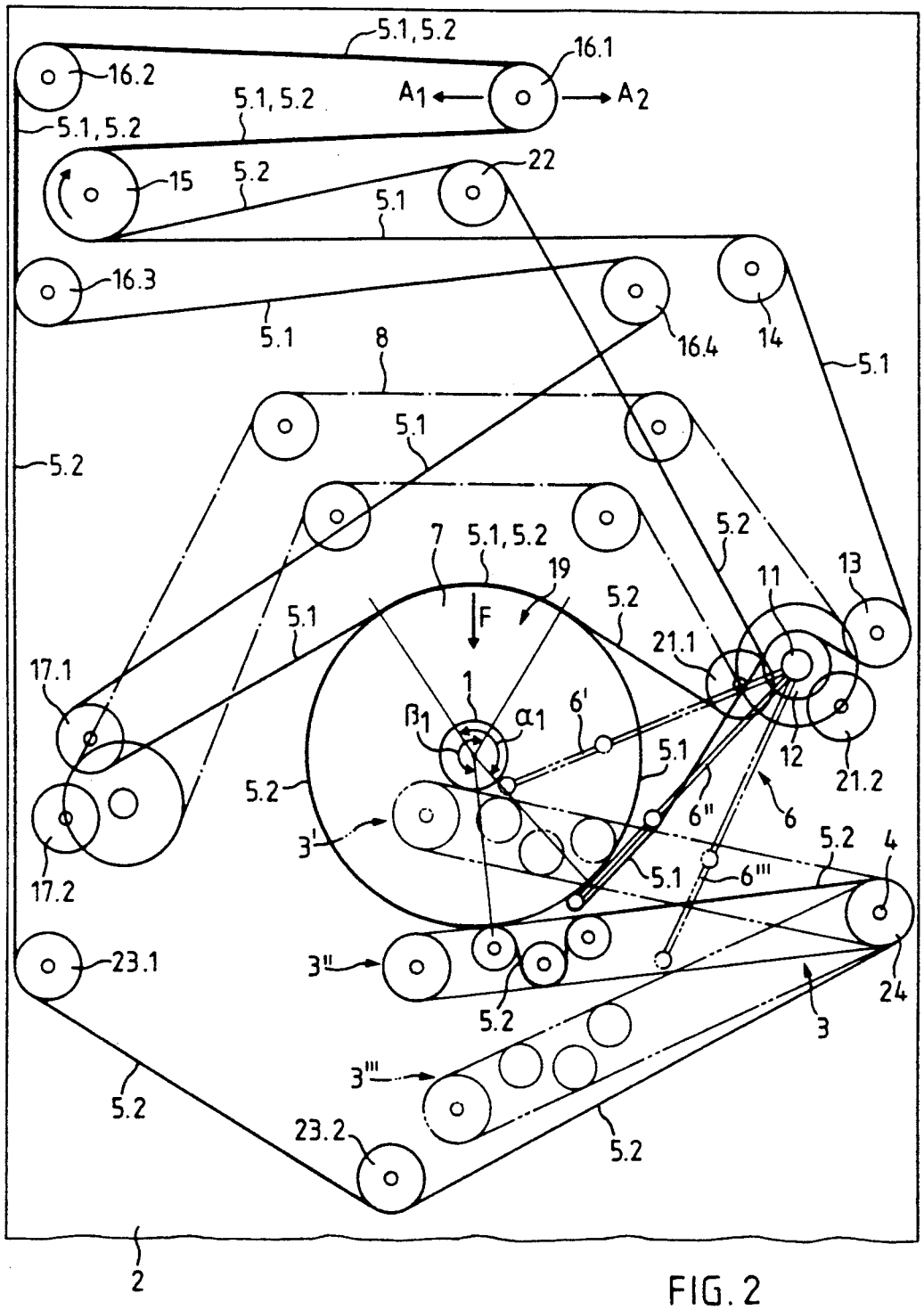
FIG. 2 is a view similar to FIG. 1 shortly before the end of the winding process with an almost full printed product roll.

FIG. 2 shows the same arrangement shortly before the end of the winding process, i.e., with the printed product roll 7 almost full. With the exception of the pulleys mounted on swivel arm 6 and on belt conveyor 3, all the guide pulleys are in the same position as at the start of the winding process. As a result of the radial increase in the printed product roll size, swivel arm 6 is swivelled outwardly and is now in its continuous line intermediate position 6''. Belt conveyor 3 is also pivoted outwardly to position 3'' which is also shown in continuous line form. Accompanied by the swinging away of belt conveyor 3, the present invention makes it possible to mount winding mandrel I in a fixed position on frame 2, i.e., it is not necessary as in the case of conventional apparatus for the winding mandrel to be mounted on a pivotable support arm or the like. This makes it possible to simplify the mechanism because the printed product roll, which is generally heavy, does not have to undergo a position change and as a result it is possible to achieve higher processing speed and greater ease of manipulation.

As can be gathered from FIG. 2, the two belts 5.1, 5.2 loop around the complete printed product roll over almost its entire circumference with the exception of an open sector of approximately 40° in the lower, right-hand area of the roll. It can also be seen that the first belt 5.1 covers the periphery over a sector $\alpha_1$ of almost 180° and the second belt 5.2 a sector $\beta_1$ of approximately 210°. Because the pressing device covers virtually the entire circumference of the printed product roll 7, very high tension can be exerted by the pressing belts, if necessary, without any asymmetrical deformation of the printed product roll during the winding process and without any disadvantageous influence on the roll rotation behavior. Another advantage of the present embodiment is that an area 19 of the printed product roll, which is simultaneously pressed by both pressing belts 5.1, 5.2 and which therefore is subject to greater pressure in the direction of the arrow F compared with other peripheral areas, faces the belt conveyor 3 (relative to the winding mandrel 1).

Figure 3:
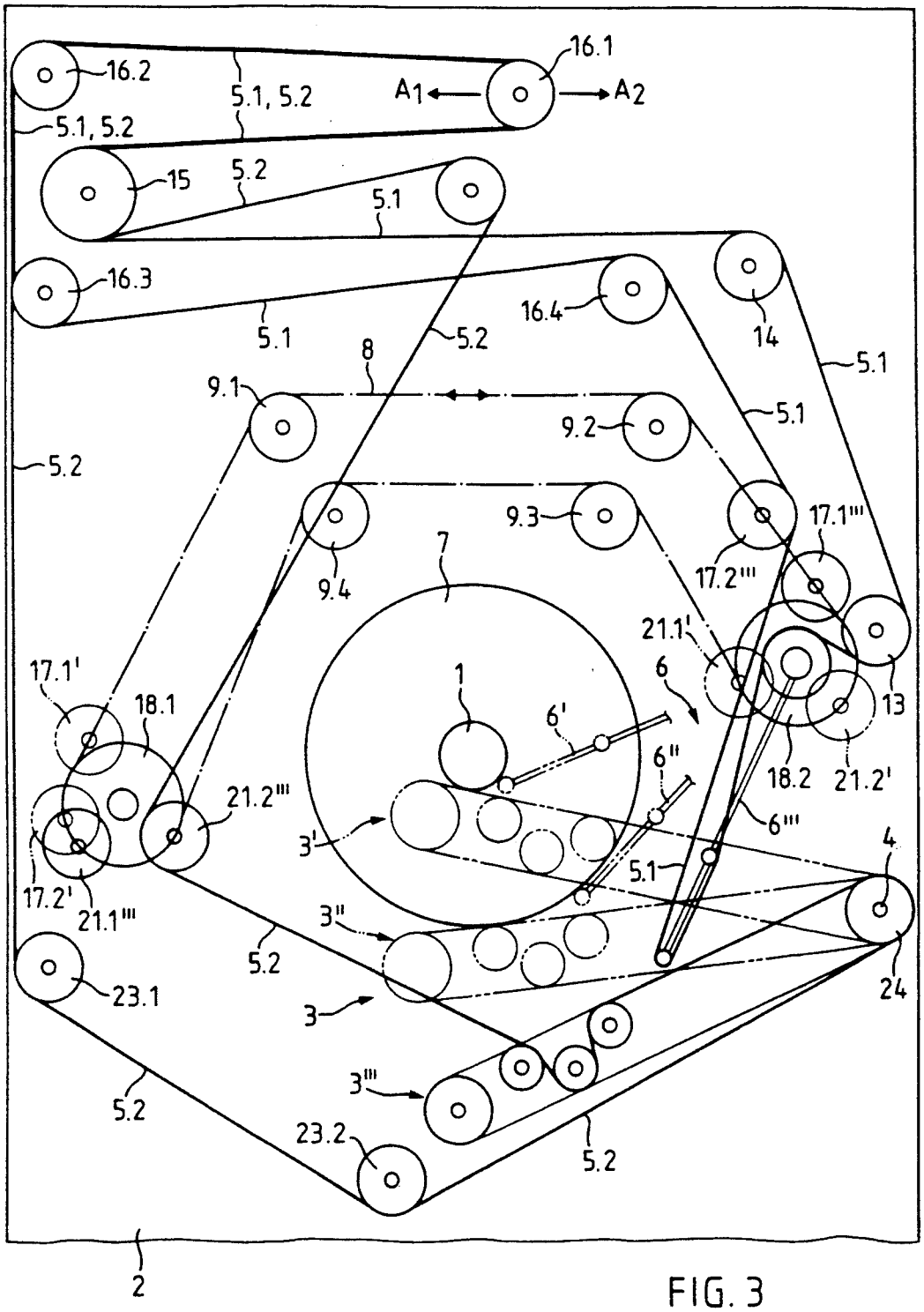
FIG. 3 is a view similar to FIGS. 1 and 2 after the end of the winding process and prior to the ejection of the full roll.

The removal of a filled printed product roll 7 will now be described with reference to FIG. 3. The removal or ejection of a filled roll takes place with the pressing belts raised, i.e., a space is created between belts 5.1, 5.2 and roll 7. In order to raise the pressing belts 5.1, 5.2 (starting from the situation shown in FIG. 2), guide pulley pairs 17.1, 17.2 and 21.1, 21.2 (FIGS. 1 and 2) are moved along their movement paths, namely, from the position shown in FIGS. 1 and 2 (designated ' in FIG. 3) into a raised position (designated with '''). This leads to the position of pressing belts 5.1, 5.2 shown in FIG. 3. The position of full roll 7 remains unchanged. The present invention permits complete and rapid raising of the pressing bolts, as will now be described. Four movement elements or groups are decisive for raising purposes, namely pivotable belt conveyor 3, swivel arm 6 and the two guide pulley pairs 17.1, 17.2 and 21.1, 21.2. These four movement groups are moved substantially simultaneously or in rapid succession from their pressing position (cf. FIG. 2) into the raising position (FIG. 3). As the moving parts are relatively lightweight parts (compared with the printed product roll which does not have to be moved), this process can take place relatively rapidly. The belt conveyor 3 is pivoted about its pivot pin 4 and brought into its raised position 3''' (shown in continuous line form) and is consequently spaced from the printed product roll. Similarly the swivel arm 6 is swivelled into its outermost position 6''' (shown in continuous line form) and is therefore also spaced from the printed product roll. As is readily apparent from FIG. 2, a mere pivoting away of both units would not be adequate in order to remove the previously brought-about looping of the roll periphery. Instead, the two guide pulley pairs 17.1, 17 2 and 21.1, 21.2 are pivoted by means of the conveyor chain 8 out of their original position ( 17.1', 17.2', 21.1' 21.2', shown in dot-dash line form) along a predetermined movement path (movement link or stable chain guide), in such a way that they arrive in new positions (17.1''', 17.2''', 21.1''', 21.2''', shown in continuous line form). It is easy to see that the guide pulley pairs follow the path of the conveyor chain, indicated by a dot-dash line, to which they are connected. Guide pulleys 17.1, 17.2 (in reverse operation) move on the outer chain path and guide pulleys 21.1, 21.2 on the inner chain path. The course of conveyor chain 8 is predetermined by means of guide pulleys 9.1 to 9.4 and has a U-shaped configuration, said U being so wide open that guide pulley pairs 17.1, 17.2 and 21.1, 21.2 can be guided with a space around a printed product roll. As can be gathered from FIGS. 1 to 3, in each case only one of the two pulleys 17.1, 17.2 or 21.1, 21.2 is active, i.e. guides a pressing belt. In the pressing position guide pulleys 17.1 and 21.1 are active and in the raised position according to FIG. 3 the two pulleys 17.2 and 21.2 are active. Guide pulley pairs 17.1, 17.2 and 21.1, 21.2 are consequently alternatively moved into two positions, namely on the one hand the pressing position (indicated with ' and in dot-dash line form) and on the other hand into the raised position (indicated with ''', continuous line form). With respect to the winding mandrel 1, these two positions face one another, i.e., they are on opposite sides of the mandrel. Conveyor chain 8 is guided about guide or driving pulleys 18.1, 18.2 in the corresponding areas. The conveyor chain is driven on both sides by a not shown drive, e.g. an electric motor. Preferably the movement of swivel arm 6 and belt conveyor 3 is obtained by the same drive, so that there is coordinated movement between these two movement groups. Simultaneously with the movement of these parts into their raised positions, the lengths of belts 5.1, 5.2 are adapted by guide pulley 16.1 or the tension thereof is reduced. Obviously, the end of the holding element must be secured to the roll prior to or simultaneously with the raising, so that the roll retains its structure after raising. The actual ejection of the full roll takes place in a conventional manner, e.g., using an ejecting blade or ejector, as known from U.S. Pat. No. 4,909,015.

Belts 5.1, 5.2 are preferably made from a slightly elastic plastic. Obviously the belts can be replaced by equivalent elements or other rotating materials. In a special embodiment of the invention, use is made of belts with structured surfaces, e.g. transverse grooves. If necessary, the belts can also have different structures, e.g. the belt at the entrance has a textured surface whereas the other belt is smooth.

Figure 4:
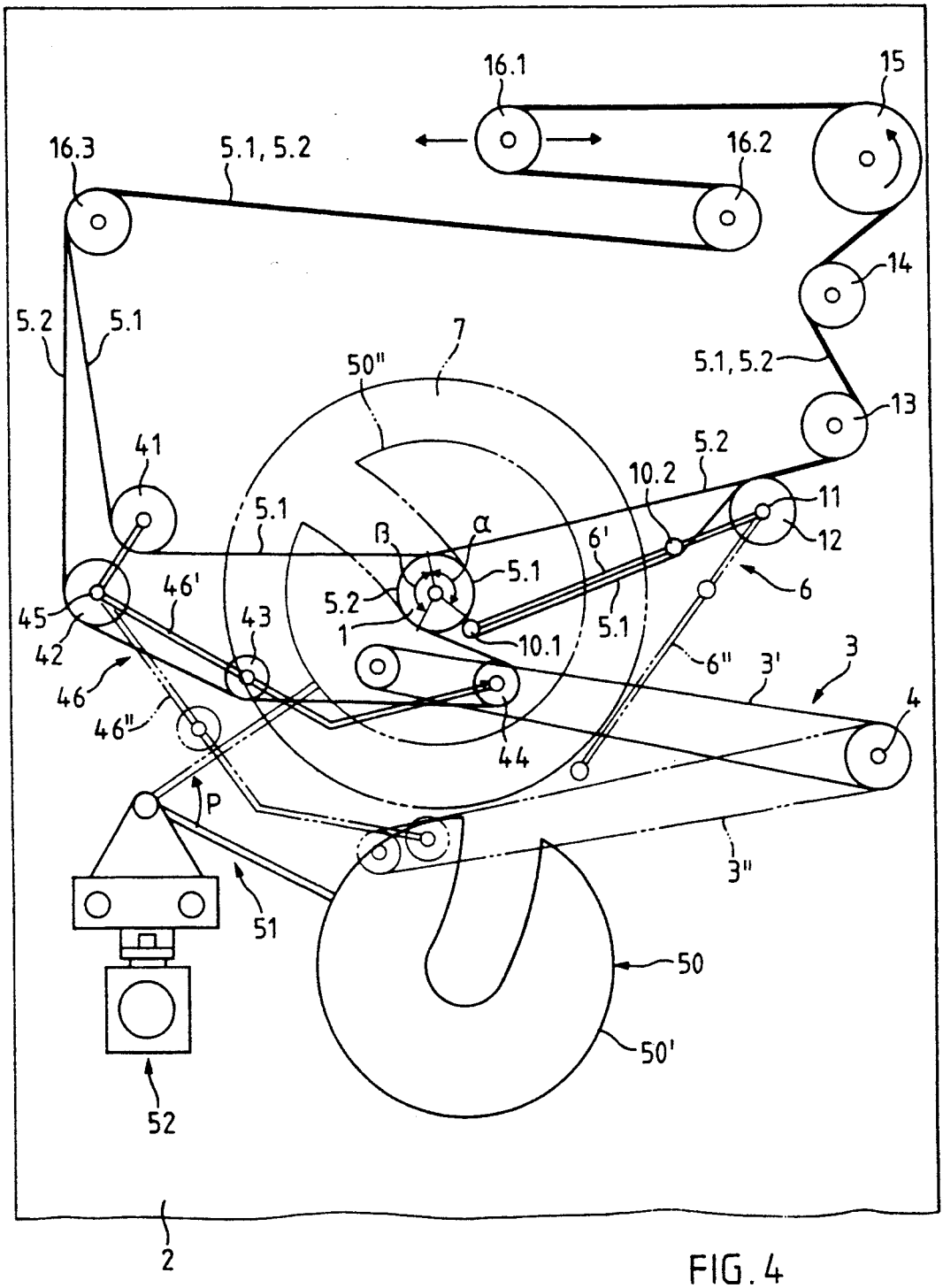
FIGS. 4, 5 and 6 are schematic side elevations of a second embodiment of an apparatus in accordance with the invention at stages corresponding to those of FIGS. 1–3.
Figure 5:
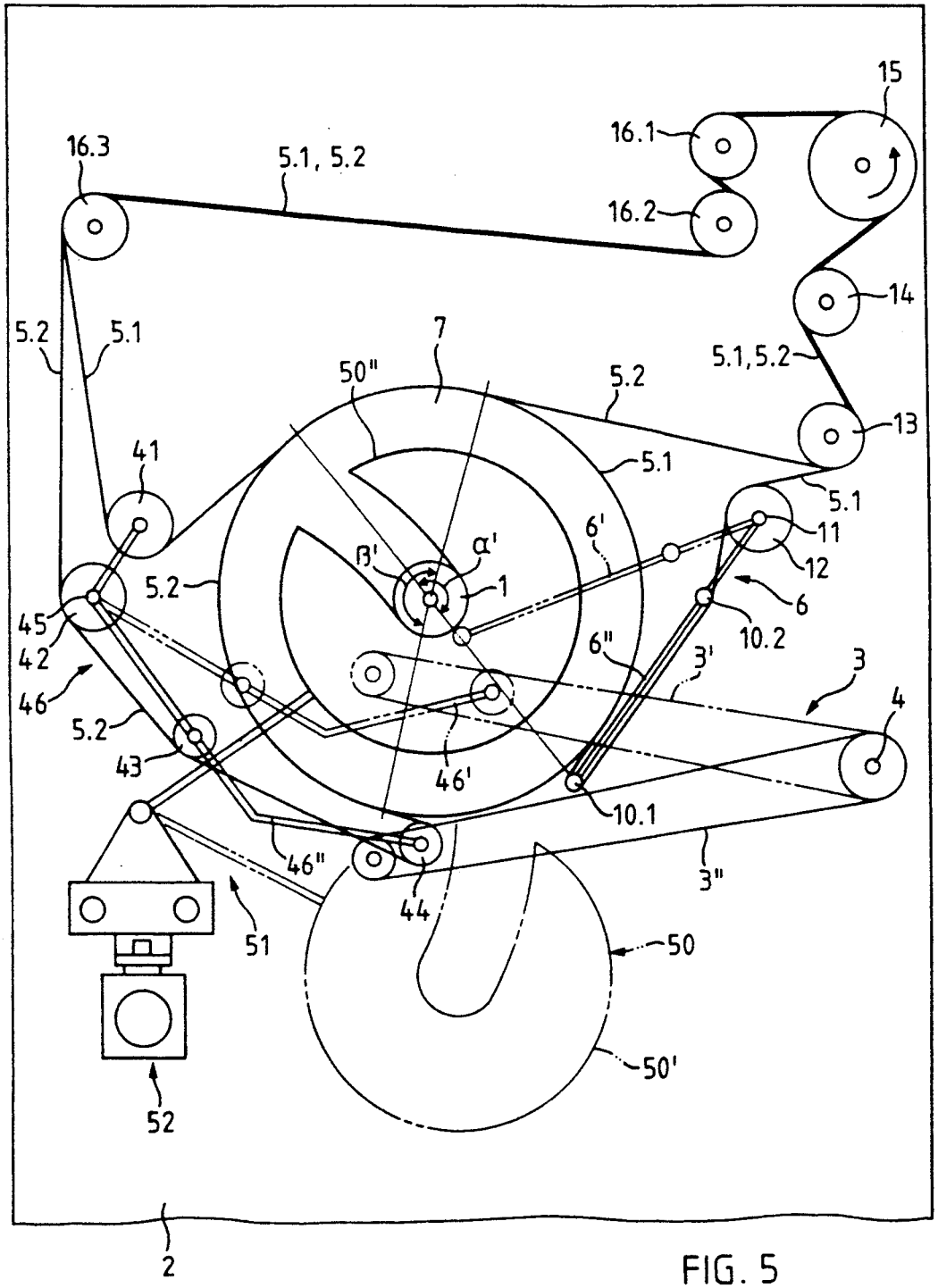
Figure 6:
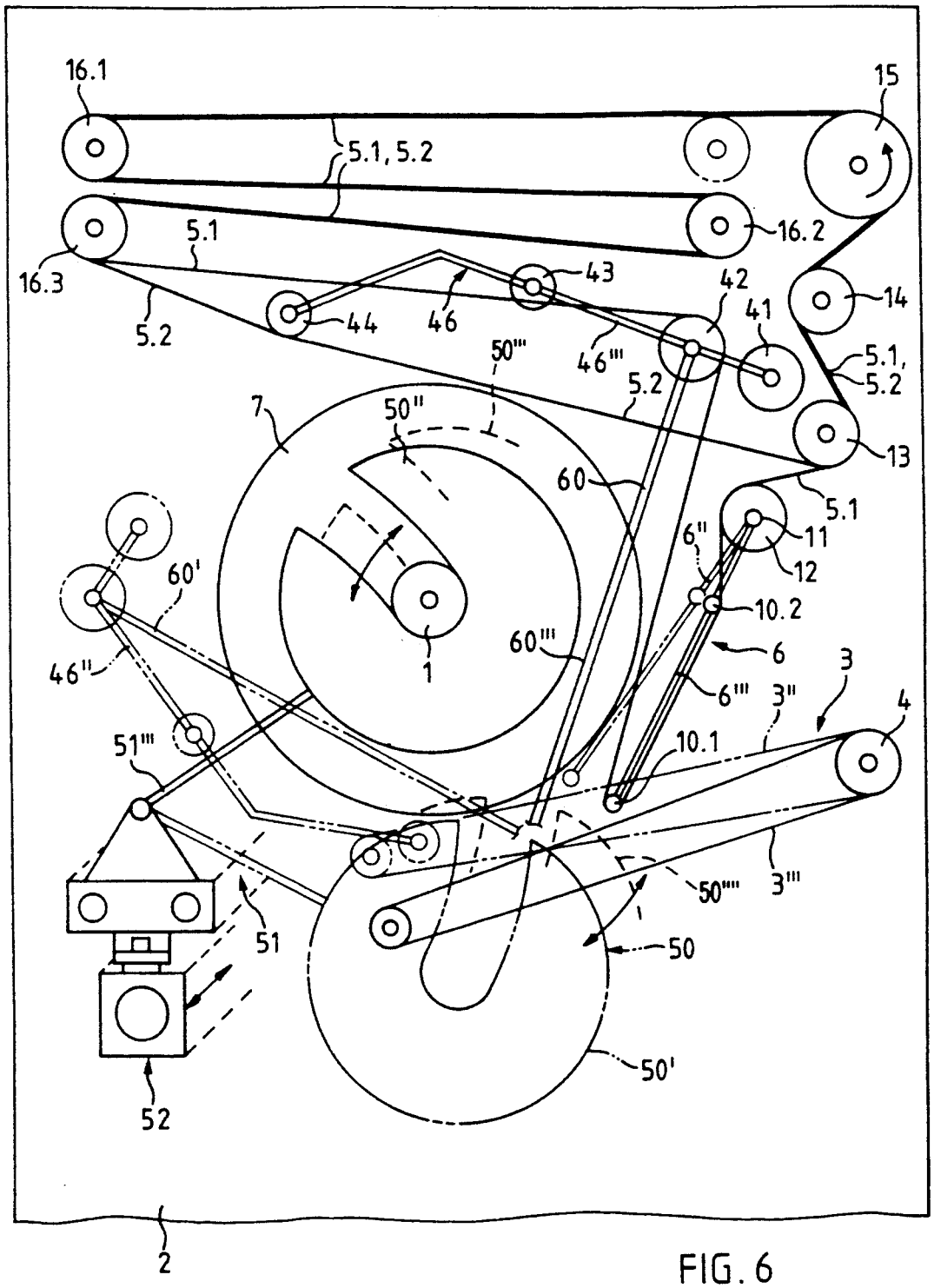

FIGS. 4 to 6 show a second embodiment of the inventive pressing and securing device at the start of the winding process (FIG. 4), i.e. with the roll still empty; with a full or almost full roll (FIG. 5); and after removing the pressing and securing elements from the roll (FIGS. 6), i.e., in the raised state. Different parts of the device are moved during the winding process and for raising and therefore assume different positions in the three drawings. These are designated with ' in the case of the empty roll (FIG. 4), with '' in the case of the full roll (FIG. 5) and with ''' in the raised state (FIG. 6). In each case, the condition on which the drawing is focused is shown in continuous line form in the drawings. For illustrating the movement, each drawing also shows a position of the moving parts corresponding to another drawing in dot-dash line form.

The embodiment of the inventive device shown in FIGS. 4 to 6 is based on the same principle as that shown in FIGS. 1 to 3, i.e. pressing and securing printed products during winding by two pressing belts applied over as large a sector as possible. Certain parts of the device have the same functions in both embodiments and essentially the same configuration and position and therefore have the same reference numerals. They are, specifically, winding mandrel 1; frame 2; belt conveyor 3 pivotable about the pivot pin 4 to pivot positions 3', 3'' and 3'''; two pressing belts 5.1 and 5.2; swivel arm 6 pivotable about pivot axle 11 and having pivot positions 6', 6'' and 6''' and small guide pulleys 10.1, 10.2 located thereon; printed product roll 7; guide pulley 12 arranged coaxially with pivot axle 11; guide pulleys 13, 14; driving pulley 15; guide pulleys 16.1, 16.2 and 16.3; and two looping angles $\alpha$ and $\beta$.

The differences between the two embodiments relate especially to those parts used for raising pressing belts 5.1 and 5.2 prior to the roll change and for the actual roll change operation In the embodiment shown in FIGS. 1 to 3, the roll change takes place in four successive stages. First, the pressing belts are withdrawn by moving various guide pulleys with a chain drive from one side to the other of the roll, after which the finished roll is ejected by an ejecting blade or ejector, the ejector is moved back and then the guide pulleys are moved back. After performing the four stages the winding station is ready to wind again.

The roll change in the embodiment of FIGS. 4 to 6 also takes place in four stages. First, the pressing belts are raised, by moving certain guide pulleys from one to the other side of the roll by levers on which they are located and then, with the aid of an ejector, the roll is ejected, followed by the return movement of the guide pulleys. After performing these three stages the winding station is again ready to wind. The ejector can be moved back during the winding process. Because the movement of the guide pulleys by levers is faster than when using a chain system and in particular because the ejector is moved back during the winding process, an even faster roll change is possible with the second embodiment (FIGS. 4 to 6). The sequence of the complete winding process with the roll change will be described in greater detail with reference to FIG. 7.

FIG. 4 shows the second embodiment of the inventive device with an empty roll, i.e. shortly before the start of the winding process. The parts of the device moved as a result of the varying radius of the growing roll are shown in dot-dash line form for a larger or finished roll, but the pressing belts 5.1 and 5.2 are only shown for the state when the roll is empty.

The course of the first pressing belt 5.1 in the winding direction, i.e. counterclockwise in the drawing is as follows. The first pressing belt 5.1 passes around two guide pulleys 10.1 and 10.2 located on swivel arm 6 so as to move away from the winding mandrel. When the winding mandrel is empty, swivel arm 6 is in position 6', i.e., it is tangential to mandrel 1. From guide pulley 10.2, the first pressing belt passes across guide pulley 12, positioned coaxially to the pivot axle II of swivel arm 6, and over two further guide pulleys 13 and 14 to driving pulley 15 and from there over three further guide pulleys 16.1, 16.2 and 16.3, pulley 16.1 being displaceable to compensate for the different belt lengths required by different roll diameters. From guide pulley 16.3 the first pressing belt 5.1 passes around a further guide pulley 41 back to the winding mandrel.

The course of the second pressing belt 5.2 in the same direction is as follows. Second pressing belt 5.2 passes away from the winding mandrel together with first pressing belt 5.1 over guide pulleys 13 and 14 to driving pulley 15 and from there over guide pulleys 16.1, 16.2 and 16 3. From guide pulley 16.3 it passes over three further guide pulleys 42, 43 and 44, and returns to the winding mandrel 1. Guide pulley 42 is coaxial with pivot axle 45 of a second swivel arm 46, on which are arranged the two guide pulleys 43 and 44. Second swivel arm 46 fulfills for the second pressing belt 5.2 the same function as the swivel arm 6 for the first pressing belt 5.1, namely that of adapting the course of the belt to the growing roll and for pressing the belt against said roll. Therefore, swivel arm 6 assumes different swivel positions, namely position 46' when the roll is empty and 46'' with a larger or full roll. Swivel arm 46 is part of a lever system also used for raising purposes and described in greater detail in conjunction with FIG. 6. From guide pulley 44, second pressing belt 5.2 returns to the winding mandrel.

Also in this second embodiment the two pressing belts 5.1 and 5.2 loop the winding mandrel 1 with looping angles $\alpha$ or $\beta$, in which $\alpha$ is approximately 140° and $\beta$ approximately 160°, so that the open sector for introducing the printed products is again approximately 60°. There is advantageously a slight overlap of the two sectors. Because the overlap grows during winding, it is not absolutely necessary for the two sectors to overlap with the roll empty. In fact, a small piece of winding mandrel circumference can remain un-looped, provided that the length of that piece does not exceed the length of one of the printed products to be wound.

FIG. 4 also shows an ejecting blade or ejector 50 which is operatively connected by an ejector lever 51 to a schematically shown drive 52, so that the ejector 50 can be pivoted in the plane of the drawing in the direction of arrow P from a position 50' into a position 50''. The ejector is also displaceable at right angles to the plane of the drawing, parallel to the axis of mandrel 1. It can also be seen that when the roll is empty (continuous line position of the two moving parts), ejector 50 can be moved at right angles to the paper plane without being hindered by any other part of the device. This is obviously also possible when the roll has a limited diameter, i.e. when the moving parts 3, 6 and 46 have already moved toward positions designated''.

FIG. 5 shows the same embodiment of the inventive device as in FIG. 4 with a full or almost full printed product roll 7. Compared with FIG. 4, because of the increased radius of roll 7, belt conveyor 3, swivel arm 6 and second swivel arm 46 have different swivel positions (3'', 6'' and 46''). The positions (3', 6', 46') occupied when the roll is empty are shown in dot-dash lines. Displaceable guide pulley 16.1 also has a different position. The course of pressing belts 5.1 and 5.2 over the different guide pulleys, which is only shown for the continuous line position of moving parts 3, 6 and 46, is changed compared with FIG. 4 because of the modified positions of guide pulleys 10.1, 10.2, 16.1, 43 and 44. The new looping angles $\alpha'$ or $\beta'$ are now approximately 180° or approximately 190°, reciprocally overlap and leave open a sector of approximately 40°.

Ejector 50 also has a different position 50'' compared with FIG. 4 (50'). It now engages laterally on the roll 7, so that the latter is ejected when ejector 50 is moved by drive 52 at right angles to the plane of the paper away from the observer, which is obviously only possible when the belts have been raised.

FIG. 6 illustrates the ejection of a full printed product roll 7 and the necessary raising of the pressing belts. The parts moved for raising and ejection are shown in their new positions compared with FIGS. 4 and 5 and designated with ''' (in continuous line form) and in dot-dash line form in the pre-raising position with full printed product roll, once again designated with ''. The two pressing belts 5.1, 5.2 are only shown in their raised position.

In the raised position belt conveyor 3 and swivel arm 6 are pivoted away from the roll (positions 3'''and 6'''). Guide pulleys 41, 42, 43, 44 are so displaced with respect to their winding position (FIGS. 4 and 5), that the pressing belts no longer come into contact with the roll 7. The displacement of guide pulleys 41, 42, 43, 44 is brought about by a pivoting movement of a raising lever 60, on which guide pulleys 41, 42 are non-displaceable relative to lever 60, but the second swivel arm 46 and therefore the guide pulleys 43 and 44 are pivotable. Raising lever 60, not shown in FIGS. 4 and 5, has an unchanged position 60' (dot-dash line) during the winding process. It is positioned laterally of roll 7 (raised out of the plane of the drawing toward the observer), so that it does not interfere with the growing roll. During the winding process there is only a change to the swivel position of second swivel arm 46. For the raising process, raising lever 60 is pivoted from its position 60' into its raising position 60''' and using a corresponding, not shown link it is ensured that the second swivel arm 46 changes its swivel position relative to raising lever 60 in such a way that it is pivoted from a pivoting position 46'' into a pivoting position 46'''. It can be seen that the movement of second swivel arm 46 necessary for raising the pressing belts must take place before or at least simultaneously with the pivoting of raising lever 60, because only in this way is it possible to move around the roll swivel arm 46 and the guide pulleys 43, 44.

As a result of the pivoting of raising lever 60 for raising purposes, all the parts of the pressing device required for the pressing function are removed from the area of drive 52 and ejector lever 51, so that they become free for an ejecting movement parallel to the roll axis, i.e. at right angles to the paper plane away from the viewer. As soon as ejector 50 has ejected the roll out of the area of the pressing belts, the latter can be brought back into the winding position of FIG. 4 by pivoting back raising lever 60, second swivel arm 46 and swivel arm 6. A new winding process can begin when the belt conveyor has been brought back into the winding position. During a first phase of the winding, ejector 50 is moved to a pivoting position corresponding to position 50', is then moved parallel to the winding or roll axis and is then brought into the ejection position 50'' by further pivoting.

Figure 7:
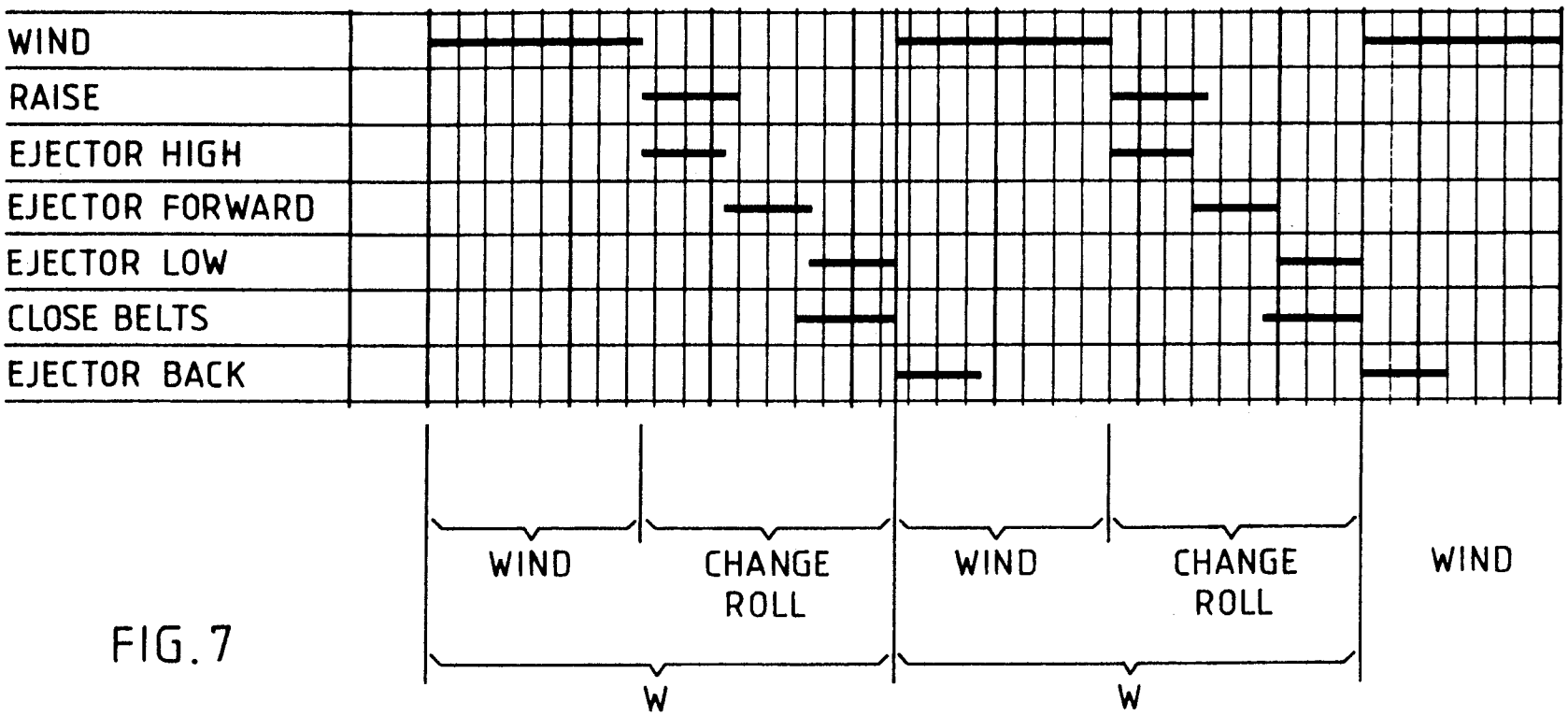
FIG. 7 is a flow chart of the winding process and the roll change for the pressing device according to FIGS. 4–6.

FIG. 7 shows the time sequence of the movements necessary for a complete winding cycle W in the embodiment according to FIGS. 4 to 6.

The abscissa of the diagram is subdivided into 0.2 second steps showing the individual steps of the winding cycle (winding and roll change). The duration of the individual steps is indicated by horizontal bars or dashes. The roll change is brought about by simultaneous raising of the pressing belts and pivoting up of the ejector, ejection of the roll and then simultaneous closing of the pressing belts and pivoting down the ejector. The described device makes it possible to change the roll in less than 2 seconds. During winding the ejector is retracted. Pivoting up and down of the ejector can also be performed during winding. However, as the roll can only be moved when the belts have been completely raised and as the pivoting of the ejector takes up less time than the raising operation, it is not possible to reduce the time taken for the roll change by pivoting the ejector during winding.

Decisive for the length of an effective winding cycle are the use-dependent winding and the device-dependent raising and ejection. These three steps determine the time required for a complete winding cycle.

The movements of belt conveyor 3, swivel arm 6 and raising lever 60 necessary for raising the pressing belts can be carried out with three different, correspondingly controlled drives, or with a single drive.

I claim:

1. An apparatus for fabricating tubular packages of printed products comprising the combination of a frame;

a winding core (1) rotatably mounted on said frame in a fixed location and having a central axis;

two flexible endless belts;

means for supporting and guiding said belts for contact with the periphery of said core and products wound thereon;

a belt conveyor (3) for delivering an imbricated stream of printed products to said core between said core and one of said belts for winding said products around said core to produce a package;

means for pivotably mounting said belt conveyor at a location remote from said core so that an end adjacent said core is movable to adapt to an increasing diameter of the package of products being wound on said core and so that said end adjacent is movable away from said core upon completion of a package;

said means for supporting and guiding said belts including a plurality of belt guiding rolls for guiding said belts in a predetermined sequence, pivotable support lever means for rotatably and transmutably mounting selected rolls of said plurality of rolls so that positions of said selected rolls are movable to adapt positions thereof to a changing diameter of a package being formed, and means for compensating lengths of portions of said belts in contact with a package being formed to said changing diameter;

release means actuatable upon completion of a package for displacing said selected rolls and changing the belt guiding sequence and for fully withdrawing said belts from said core and products wound thereon; and an ejector movable axially relative to said core for removing a completed tubular package form said winding core.

2. An apparatus according to claim 1 wherein said means for compensating includes means for mounting one of said plurality of rolls so that a central axis of said roll is movable in two directions relative to said frame.

3. An apparatus according to claim 1 wherein at least one of said belts has a textured surface.

4. An apparatus according to claim 1 wherein said release means includes an endless drivable chain, guide rollers for establishing a path of movement for said chain and a pair of belt guiding rollers for each belt, each pair including a primary belt guiding roller in contact with a belt while forming a package and an auxiliary roller, said belt guiding rollers being carried by said chain so that, when said release means is actuated, said primary rollers are moved out of contact with said belts and said auxiliary rollers are moved into guiding contact with said belts and said belts are moved away from said core and printed products wound thereon.

5. An apparatus according to claim 1 wherein said release means includes a pivotably mounted release lever (60) pivotable between first and second positions, said release lever acting on said selected rolls (41, 42, 43, 44) for displacing said selected rolls for changing contact between said rolls and said belts and for fully withdrawing said belts from said core and products wound thereon.

6. An apparatus according to claim 5 wherein said release lever (60) is pivotable at right angles to said winding core central axis and wherein a plurality of belt guide rolls and said pivotable support lever means are carried by said release lever (60).

7. An apparatus according to claim 5 and including means for pivoting said ejector away from said winding core axis.

* * * * *